United States Patent [19]

Bombrini

[11] Patent Number: 5,022,092

[45] Date of Patent: Jun. 11, 1991

[54] MOTORCYCLIST'S JACKET WITH A REAR HELMET-CARRYING POUCH

[75] Inventor: Carlo Bombrini, Bologna, Italy

[73] Assignee: C.P. Company S.p.A., Italy

[21] Appl. No.: 337,698

[22] Filed: Apr. 13, 1989

[30] Foreign Application Priority Data

Apr. 21, 1988 [IT] Italy ..... 53083/88[U]

[51] Int. Cl.[5] ..... A41D 1/00; A41D 1/04

[52] U.S. Cl. ..... 2/94; 2/102; 2/108; 2/247

[58] Field of Search ..... 2/69, 72, 93, 94, 95, 2/102, 103, 108, 213, 247, 249, 250, 251, 253; 224/151, 153, 205

[56] References Cited

U.S. PATENT DOCUMENTS

| | | | |
|---|---|---|---|
| 227 | 1/1893 | Jacobs | 2/102 |
| 2,338,535 | 1/1944 | Pfleumer | 2/102 |
| 4,563,777 | 1/1986 | Park | 2/108 |
| 4,669,127 | 6/1987 | Swanson | 2/102 |
| 4,689,831 | 9/1987 | Greenberger et al. | 2/94 |
| 4,872,215 | 10/1989 | Sliger | 2/102 |

FOREIGN PATENT DOCUMENTS

| | | | |
|---|---|---|---|
| 8104054 | 2/1981 | France | 2/93 |
| 266133 | 7/1929 | Italy | 2/94 |

*Primary Examiner*—Werner H. Schroeder
*Assistant Examiner*—Gloria Hale
*Attorney, Agent, or Firm*—Sughrue, Mion, Zinn, Macpeak & Seas

[57] ABSTRACT

A jacket (1) for motorcyclists comprises a waist-coat constituted by a band (2) which is intended to be wrapped around the trunk of a user (3), the band (2) including a central part (4) which is intended to be situated in correspondence with the back of the user (3), two end flaps (5) which can be closed together at the front, and a pair of adjustable braces (14) associated with the band (2), the jacket (1) being further provided with a rear pouch (6) connected to the central part (4) of the band (2), of a size suitable for holding the motorcyclist's helmet (7).

8 Claims, 2 Drawing Sheets

MOTORCYCLIST'S JACKET WITH A REAR HELMET-CARRYING POUCH

BACKGROUND OF THE INVENTION

The present invention relates to a motorcyclist's jacket provided with a rear helmet-carrying pouch.

The need to avoid or at least to limit damage caused by head injuries resulting from falls from two-wheeled vehicles has forced ever-increasing numbers of their users to wear protective helmets. In certain countries, moreover, this practice has been made compulsory for some categories of user travelling on certain types of these vehicles.

All this has fortunately lead to a limitation of the consequences of numerous accidents but obliges the user to carry his helmet, which is generally rather bulky, with him, holding it in his hand if he cannot place it in a safe place upon dismounting his vehicle. Clearly, this is particularly irksome for users, for example, messengers, who use two-wheeled vehicles for several successive journeys separated by short intervals during which they need freedom of movement.

SUMMARY OF THE INVENTION

The object of the present invention is to avoid the problem mentioned and its subject, therefore, is constituted by a jacket for motorcyclists, characterised in that it comprises a waistcoat constituted by a band which is intended to be wrapped around the trunk of the user, the band including central part which is intended to be situated in correspondence with the user's back, two end flaps which can be closed together at the front, and a pair of adjustable braces associated with the band, the jacket being further provided with a rear pouch connected to the central part of the band, of a size suitable for holding the motorcyclist's helmet.

BRIEF DESCRIPTION OF THE DRAWINGS

Further characteristic and advantages of the present invention will become clear from the detailed description which follows with reference to the appended drawings, provided by way of non-limiting example, in which.

DETAILED DESCRIPTION OF THE INVENTION

Figure 1:
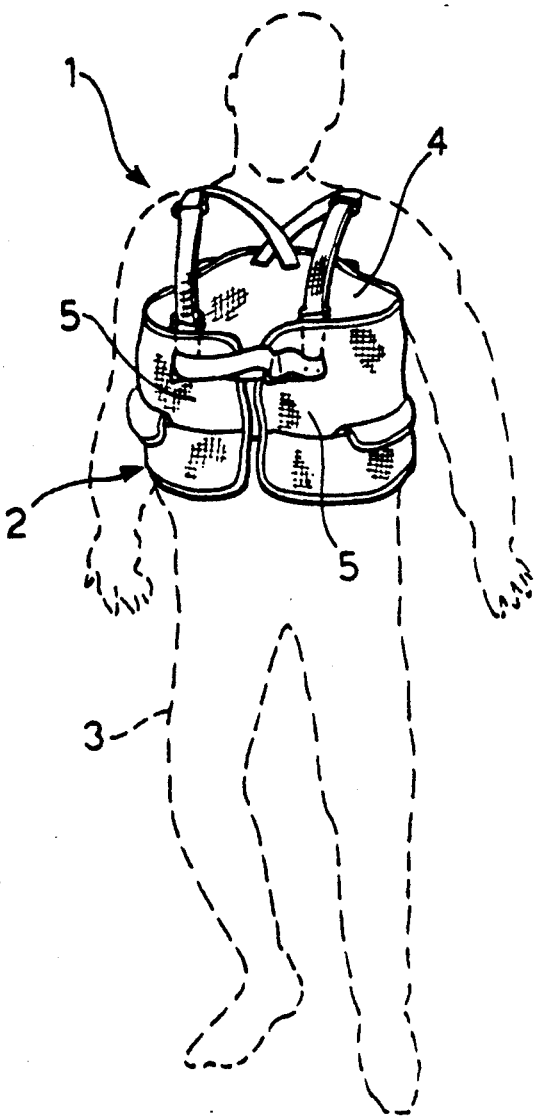
FIGS. 1 and 2 show a jacket according to the invention worn by a user.
Figure 2:
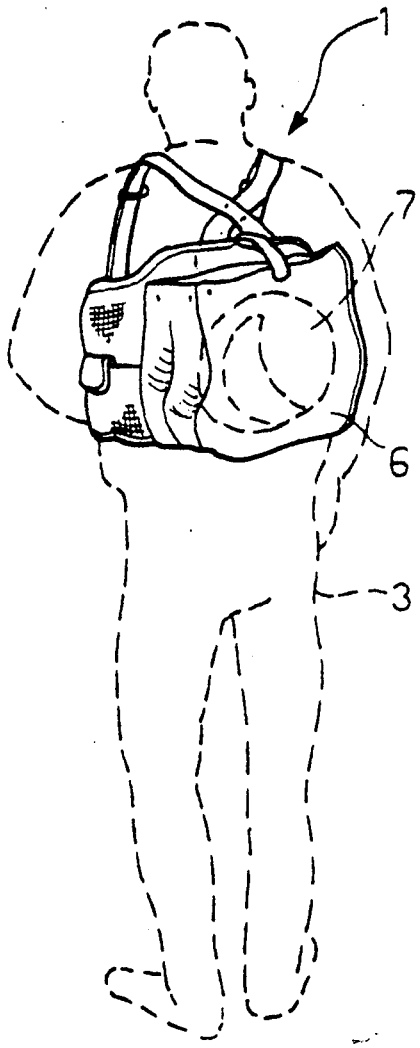

A jacket 1 (FIGS. 1 and 2) comprises a waistcoat constituted by a band 2 which is intended to be wrapped around the trunk of a motorcyclist-user 3. (In this description, the term motorcyclist means the driver and any passenger of any two-wheeled vehicle either with an engine, for example a motorcycle or a moped, or without, such as a bicycle).

Figure 3:
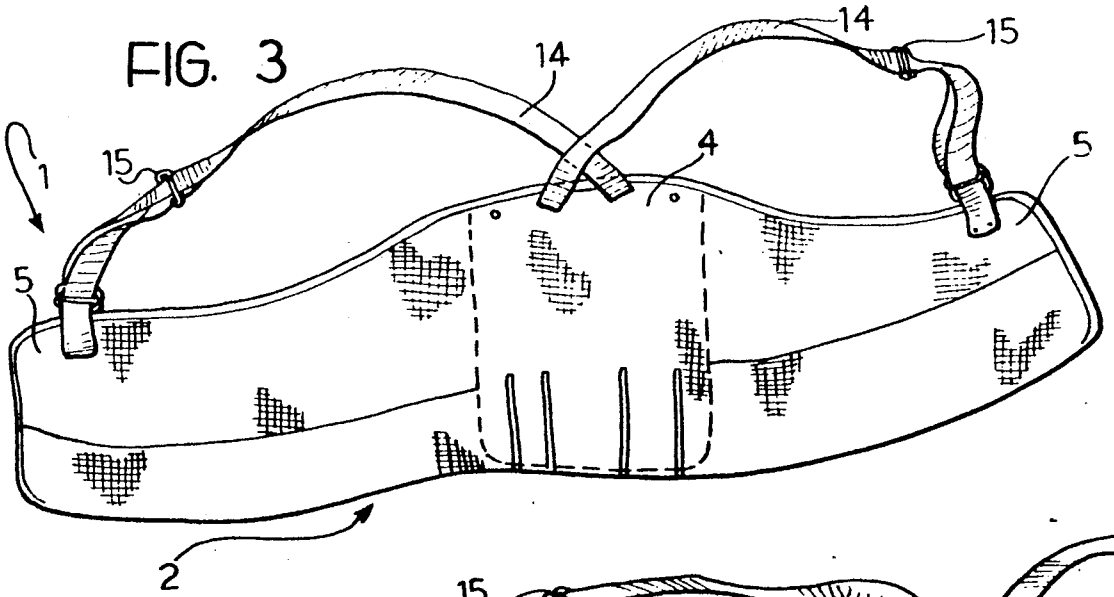
FIG. 3 is a perspective front view of a jacket according to the invention.
Figure 4:
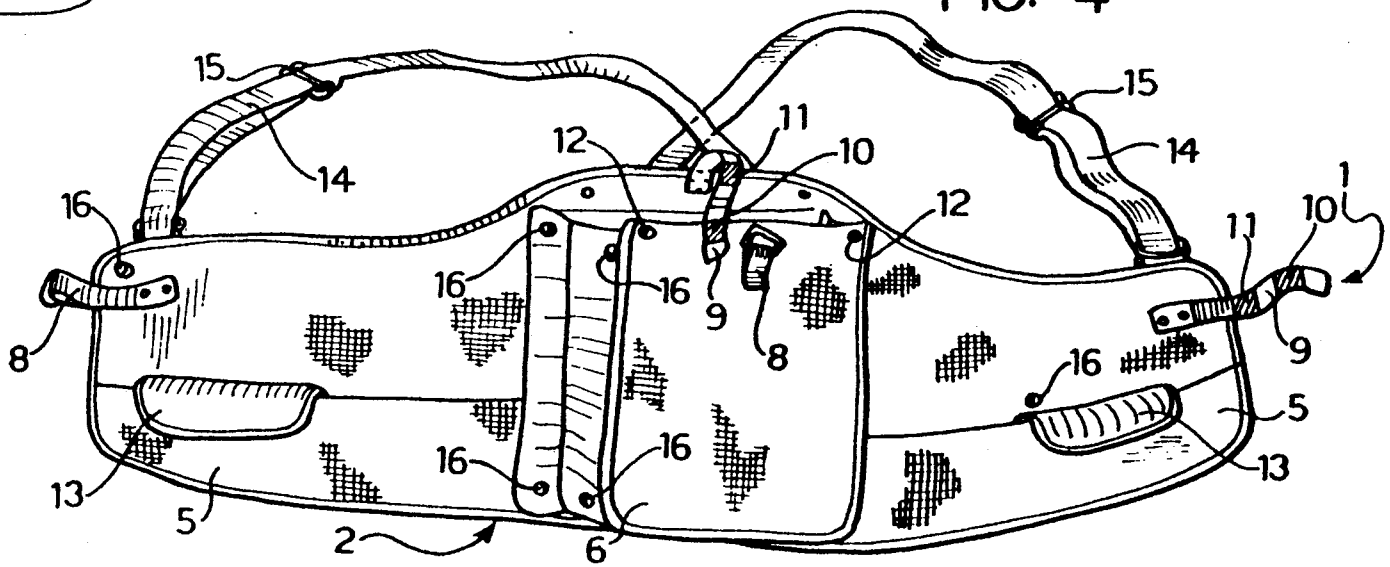
FIG. 4 is a perspective rear view of a jacet according to the invention.

The band 2 (FIGS. 3 and 4) includes two end flaps 5 and a central part 4 which is intended to be situated in correspondence with the motorcyclist's back and to which a rear pouch 6 is attached, preferably by sewing, for holding a motorcyclist's helmet 7.

The pouch 6 is provided with means for its opening/closure. In a preferred embodiment, these means are constituted by a buckle 8 and a strap 9 associated with the pouch 6 and with the central rear part 4 of the band 2, respectively. The strap 9 can slide into the buckle 8 and, on one of its faces, has a first surface 10 which is provided with microhooks and a second surface 11 which is spaced from the first surface 10 and is adapted releasably to engage the microhooks. The latter can be engaged after the sliding of the strap 9 into the buckle 8 and the putting together of the two surfaces 10, 11, to cause the closure of the pouch 6. The subsequent opening of the pouch 6 is made possible by an energetic pulling action on the strap 9, which causes the disengagement of the microhooks. Two press-studs 12 further ensure the closure of the pouch 6.

The end flaps 5 of the band 2 are provided at the front with opening/closure means of similar structure and operation to those described above for the pouch 6. There is at least one pocket 13 on the front portions of the flaps 5.

A pair of braces 14, whose length can be adjusted by means of buckles 15, is associated with the band 2 and enables the jacket 1 to be fitted to the user.

Press-studs 16 are also arranged on the flaps 5 of the band 2 and on the side surface of the pouch 6 to enable the bulk of the jacket 1 to be reduced to a minimum when it is not being worn.

The functionality of the jacket according to the invention is clear from the above description. In fact, as soon as he has dismounted from his vehicle, the motorcyclist can place his helmet in the pouch and put on the jacket, thus retaining full freedom of movement.

The jacket can be made so as to fulfill also the function of an elastic body-belt and can be provided on its back with stiffening bones.

What is claimed is:

1. A jacket (1) for motorcyclists comprising a waistcoat including a band (2) intended to be wrapped around a trunk of a user (3), the band (2) including a central rear part (4) intended to be situated in correspondence with the back of the user (3), two end flaps (5) closable together at the front of the user, and a pair of adjustable braces (14) associated with the band (2), the jacket (1) being further provided with a rear pouch (6) connected to the central part (4) of the band (2), of a size suitable for storing a motorcyclist's helmet (7).

2. A jacket according to claim 1, wherein the rear pouch (6) is sewn to the central part (4) of the band (2).

3. A jacket according to claim 1, wherein the jacket has at least one pocket (13) on said end flaps at the front of the user.

4. A jacket according to claim 1, wherein said jacket includes means for the opening and closing of the pouch (6).

5. A jacket according to claim 4, wherein the opening and closing means comprise a buckle (8) and a strap (9) with two sides associated with the pouch (6) and with the central rear part (4) of the band (2) respectively, the strap (9) being able to slide into the buckle (8) and having, on one of its sides, a first surface (10) provided with microhooks and a second surface (11) spaced from the first surface being able to releasably engage the microhooks, the engagement of the microhooks taking place after the sliding of the strap (9) into the buckle (8) and the engagement of the two surfaces (10, 11), to cause the closure of the pouch (6).

6. A jacket according to claim 2, wherein the pouch (6) has at least one press-stud (12) for causing its closure or opening in association with the buckle (8) and the strap (9).

7. A jacket according to claim 1, wherein the jacket includes means for the opening or closing of the end flaps (5) of the band (2).

8. A jacket according to claim 7, wherein the opening and closing means comprise a buckle (8) and a strap (9) with two sides each associated with a respective one of the flaps (5), the strap (9) being able to slide into the buckle (8) and having on one end of its sides, a first surface (10) which is provided with microhooks and a second surface (11) which is spaced from the first surface and is able to releasably engage the microhooks, the engagement of the microhooks taking place after the sliding of the strap (9) into the buckle (8) and the putting together of the two surfaces (10, 11), to cause the closure of the end flaps (5) of the band (2).

* * * * *